US005400907A

United States Patent [19]

Chen

[11] Patent Number: 5,400,907

[45] Date of Patent: Mar. 28, 1995

[54] MUG WITH SWIVEL-RINGS

[75] Inventor: Pang-cheng Chen, Taipei, Taiwan, Prov. of China

[73] Assignee: Promotion-Plus International, Ltd., Taipei, Taiwan, Prov. of China

[21] Appl. No.: 273,975

[22] Filed: Jul. 12, 1994

[51] Int. Cl.[6] ..... B65D 25/28

[52] U.S. Cl. ..... 206/459.1; 220/756

[58] Field of Search ..... 206/457, 459.1; 220/750

[56] References Cited

U.S. PATENT DOCUMENTS

| | | | |
|---|---|---|---|
| 2,233,614 | 3/1941 | Krotoschiner | 206/459.1 |
| 2,938,282 | 5/1960 | Spielman | 206/459.1 |
| 3,818,858 | 6/1974 | Kramer et al. | 206/459.1 |
| 3,960,713 | 6/1976 | Carey | 206/459.1 |
| 4,336,882 | 6/1982 | Sakkwa | 206/459.1 |
| 4,779,722 | 10/1988 | Hall | 206/459.1 |
| 4,877,119 | 10/1989 | Hosking | 206/459.1 |
| 5,275,277 | 1/1994 | Gallegos | 206/457 |

*Primary Examiner*—Joseph Man-Fu Moy

*Attorney, Agent, or Firm*—Beveridge, DeGrandi, Weilacher & Young

[57] ABSTRACT

A mug with swivel-rings includes a cylindrical mug body having an outward flange around the top opening, a locating ring mounted around the mug body at the bottom through a high-frequency sealing process, an arched handle having two opposite ends respectively fixedly fastened to the outward flange of the mug body and the locating ring, and a plurality of swivel-rings revolvably mounted around the mug body and stopped between the outward flange of the mug body and the locating ring. The swivel-rings are respectively printed with a series of numbers or drawings such that they can be turned for learning or teaching arithmetic, or for providing various changeable patterns.

6 Claims, 2 Drawing Sheets

MUG WITH SWIVEL-RINGS

BACKGROUND OF THE INVENTION

The present invention relates to mugs, and relates more particularly to such a mug having a plurality of swivel-rings mounted around the periphery at different elevations and printed with different drawings or patterns.

In order to attract people to buy, regular mugs are commonly printed with drawings or patterns. As the drawings or patterns of regular mugs are not changeable, they will become less attractive after a certain period in use.

SUMMARY OF THE INVENTION

It is one object of the present invention to provide a mug with swivel-rings which can be alternatively arranged to present different drawings or patterns. It is another object of the present invention to provide a mug with swivel-rings which can be used as means for practicing or learning the mathematics of multiplication.

According to one aspect of the present invention, the mug comprises a cylindrical mug body having an outward flange around the top opening, a locating ring mounted around the mug body at the bottom, an arched handle having two opposite ends respectively fixedly fastened to the outward flange of the mug body and the locating ring, and a plurality of swivel-rings revolvably mounted around the mug body and stopped between the outward flange of the mug body and the locating ring. According to another aspect of the present invention, the swivel-rings are respectively printed with a series of numbers such that they can be turned for learning the mathematics of multiplication. As an alternate form of the present invention, the swivel-rings may be printed with different drawings.

DETAILED DESCRIPTION OF THE PREFERRED EMBODIMENT

Figure 1:
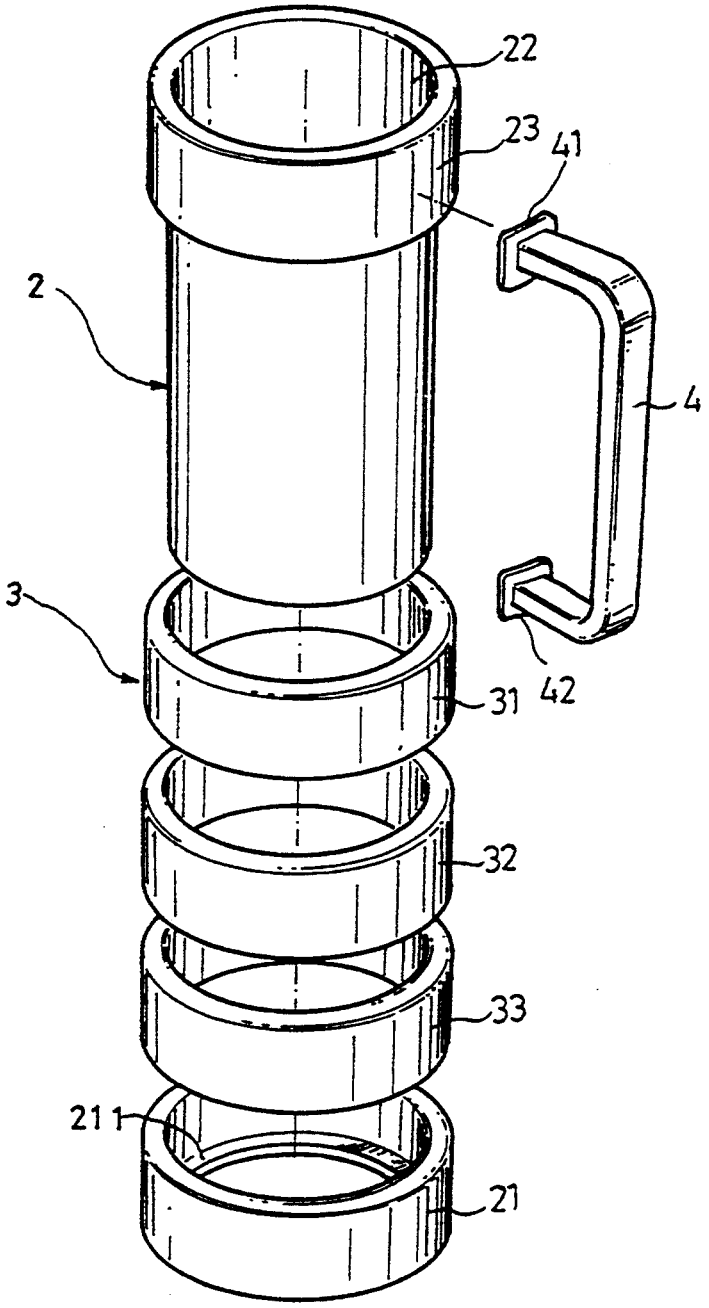
FIG. 1 is an exploded view of a mug according to the present invention.
Figure 2:
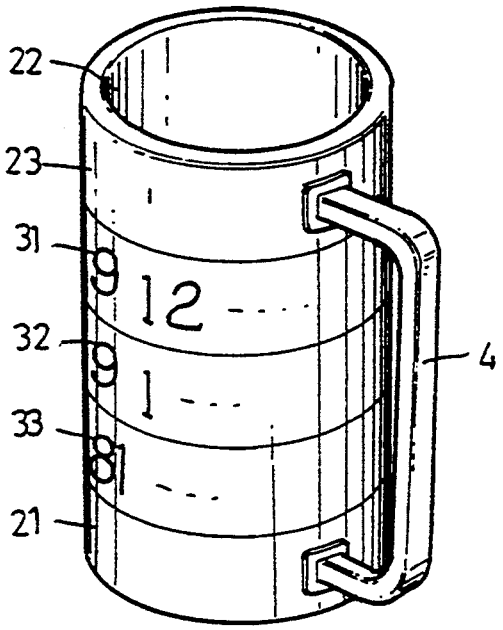
FIG. 2 is an elevational view of the present invention, showing the swivel-rings printed with a series of numerals.

Referring to FIGS. 1 and 2, a mug in accordance with the present invention is generally comprised of a cylindrical mug body 2, a locating ring 21, a plurality of swivel-rings 3, and a handle 4. The mug body 2 defines a cylindrical holding chamber 22 for holding water, and has an outward flange 23 around the top open end. The locating ring 21 has an inward flange 211 projected from the inside wall thereof at the bottom. The inner diameter of the locating ring 21 is approximately equal to the outer diameter of the bottom end of the mug body 2. When the bottom end of the mug body 2 fits into the locating ring 21, it is stopped at the inward flange 211. The handle 4 is made of arched shape having two opposite ends 41 and 42 respectively fastened to the outward flange 23 of the mug body 2 and the locating ring 21. The locating ring 21 can be fastened to the mug body 2 through a high-frequency sealing process. Similarly, the two opposite ends 41 and 42 of the handle 4 can be respectively fastened to the outward flange 23 of the mug body 2 and the locating ring 21 through a high-frequency sealing process. The swivel-rings 3 are respectively revolvably mounted around the mug body 2 and stopped between the outward flange 23 of the mug body 2 and the locating ring 21 at different elevations. By inserting the fingers through the space defined between the handle 4 and the mug body 2, the mug is held in the hand.

Referring to FIG. 2, the swivel-rings 3 include three rings, namely, the top ring 31, the intermediate ring 32, and the bottom ring 33. A series of numbers from 1 to 9 are marked around the outside wall of the top ring 31 as well as the intermediate ring 32 in proper order. A series of numbers from 1 to 81 are marked around the outside wall of the bottom ring 33. Therefore, by turning the rings 31, 32 and 33, one can practice or teach the arithmetic of multiplication.

Figure 3:
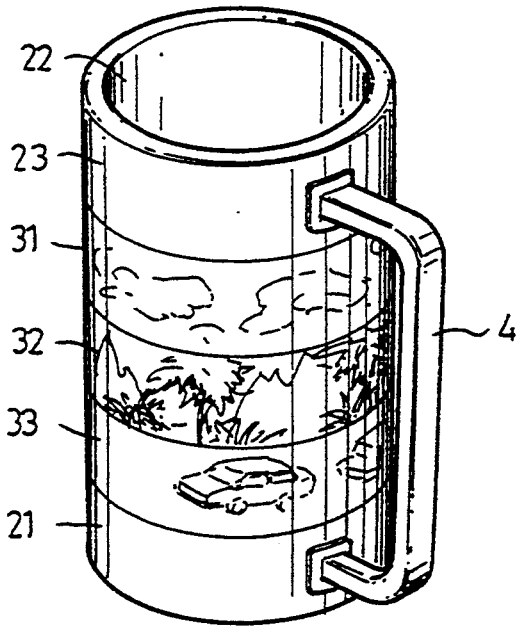
FIG. 3 is an elevational view of an alternate form of the present invention, showing the swivel-rings printed with different drawings.

FIG. 3 illustrates an alternate form of the present invention in which the three rings 31, 32 and 33 of the swivel-rings 3 are respectively printed with a respective drawing, for example: the top ring 31 is printed with a drawing showing different weather conditions; the intermediate ring 32 is printed with a drawing showing different plants and figures and; the bottom ring 33 is printed with a drawing showing different road conditions. Therefore, by turning the rings 31, 32 and 33, it provides various patterns for a different outlook.

What is claimed is:

1. A mug with swivel-rings, comprising:

a mainbody, a plurality of rings, a ring base and a handle, wherein:

said mainbody has an opening at a top end thereof, and a space for containing goods therein, said opening further has a flange outside thereof;

said plurality of rings are in the shape of hollow rings located on a peripheral wall of said mainbody, wherein said rings are able to swivel freely;

said ring base fastens on a bottom of said mainbody, and with the aid of said flange of said opening, said ring base restricts the movable scope of said rings on said mainbody; and said handle is fastened to the mug for taking and holding thereon;

wherein a peripheral wall of said rings can be marked to include different paintings or drawings matched with one another.

2. A mug with swivel-rings as in claim 1, wherein an interior of each of the plurality of rings is compatible with the shape of the mainbody.

3. A mug with swivel-rings as in claim 2, wherein said mainbody is in a circular shape, and the interior of each of said corresponding rings is in the shape of a circular ring.

4. A mug with swivel-rings as in claim 1, wherein an interior of said ring base is compatible with the shape of the mainbody.

5. A mug with swivel-rings as in claim 4, wherein said ring base is in the shape of a circular ring.

6. A mug with swivel-rings as in claim 1, wherein said handle has two fixed portions, one fixed portion on each respective end thereof, for fastening onto said ring base and onto said flange of said mainbody, respectively.

* * * * *